US006035848A

United States Patent [19]

Ray et al.

[11] Patent Number: 6,035,848

[45] Date of Patent: Mar. 14, 2000

[54] OVEN AND RANGE DOOR LOCK MECHANISM

[75] Inventors: Keith Ray, Delaware; Kenneth L. Davis, Vandalia; Jeffrey H. Stachowski, West Carrollton, all of Ohio

[73] Assignee: Whirlpool Corporation, Benton Harbor, Mich.

[21] Appl. No.: 09/108,944

[22] Filed: Jul. 1, 1998

[51] Int. Cl.[7] ..... F23M 7/00

[52] U.S. Cl. ..... 126/194; 16/362; 49/465

[58] Field of Search ..... 126/191, 194, 126/197; 16/362; 49/386, 394, 463, 465; 292/202, 204, 54, 195; 248/221.11

[56] References Cited

U.S. PATENT DOCUMENTS

| | | | |
|---|---|---|---|
| 3,040,732 | 6/1962 | Doner | 126/191 |
| 3,072,117 | 1/1963 | Stoligrosz et al. | 126/191 |
| 3,123,064 | 3/1964 | Hartson | 126/191 |
| 3,191,217 | 6/1965 | Squire | 16/145 |
| 3,327,701 | 6/1967 | Smith | 126/194 |
| 3,601,432 | 8/1971 | Fenwick | 287/189.36 |
| 3,677,259 | 7/1972 | Doner | 126/194 |
| 3,889,654 | 6/1975 | Kauranen et al. | 126/194 |
| 3,922,870 | 12/1975 | Recaide | 61/72.3 |
| 4,001,973 | 1/1977 | Rice et al. | 126/194 |
| 4,194,321 | 3/1980 | Hess | 49/389 |
| 4,979,264 | 12/1990 | Ramsauer | 16/264 |
| 5,452,544 | 9/1995 | Weathington, Sr. | 49/394 |
| 5,822,925 | 10/1998 | McKinney et al. | 126/194 |
| 5,881,710 | 3/1999 | Davis et al. | 126/194 |
| 5,937,481 | 8/1999 | Faringosi | 126/191 |

*Primary Examiner*—Ira S. Lazarus
*Assistant Examiner*—Sara Clarke
*Attorney, Agent, or Firm*—Andrea Powers Denklau; Joel M. Van Winkle; Robert O. Rice

[57] ABSTRACT

A hinge assembly for an oven or range that allows a door to be attached to the cooking chamber, locked in place and removed as desired. The hinge assembly includes a hanger mounted to the door and a locking arm mounted to the hanger. The oven or range chamber has at least one pin for receiving a channel on the hanger. When the locking arm is pivoted to an unlocked position with the hanger channel open, the hanger can receive or disengage the pin. When the locking arm is pivoted to an unlocked position with the hanger channel closed, the pin is trapped and the door is secured to the cooking chamber.

10 Claims, 5 Drawing Sheets

OVEN AND RANGE DOOR LOCK MECHANISM

BACKGROUND OF THE INVENTION

1. Field of the Invention

The present invention relates to an oven or range door, and more specifically to a locking assembly that keeps the door attached to the cooking chamber when the assembly is locked and allows for removal of the door when the assembly is unlocked.

2. Description of the Related Art

The general construction of ovens and ranges is well known in the art. Typically, an oven or range includes a cooking chamber with a door for access to the chamber. The chamber is basically square or rectangular in shape, with opposed top and bottom walls, opposed side walls and a back wall opposite an opening. The opening is closed and opened by a door that is basically the same square or rectangular shape as the back wall. Usually the door is attached to the cooking chamber along the bottom edge and pivots about this horizontal axis between open and closed positions.

There are several configurations for attaching a door to a cooking chamber, basically providing either a permanently attached door or a removable door. In the first instance, the door may be attached by an arm that pivots about an elongate pin on the chamber. For example, an arm may be located along both sides of the bottom edge of the door and encircle a pin that spans approximately the width of the chamber. Or, a typical door hinge configuration More typically, oven doors are removable from the cooking chamber. This can be accomplished with several configurations, such as those shown in U.S. Pat. Nos. 3,040,732; 3,015,125; 3,072,117 and 3,677,259. One arrangement consists of a slotted hanger attached to the door that is hooked on a pin attached to the chamber, allowing the door to hang on the chamber. In this configuration disclosed in U.S. patent application Ser. No. 60/053,721, the door pivots and the hanger remains stationary.

Unfortunately, when a door is permanently attached to the cooking chamber, it is often difficult to access the interior of the chamber for cleaning or repair. However, a door that is not permanently attached, is, of course, not as secure to the chamber as one that is permanently attached. Therefore, it is desirable to have a removable door that can be securely locked to the cooking chamber and unlocked and removed as desired, especially one consisting of a simple construction.

SUMMARY OF THE INVENTION

The present invention is directed to a hinge assembly for an oven or range that has a door and a cooking chamber, with the door pivoting about a horizontal axis to open and close the cooking chamber. The hinge assembly has a hanger that pivots on the door and allows the door to be attached to the cooking chamber. Once attached to the chamber, a locking arm on the hanger keeps the door in place. In this way, the door is securely attached to the cooking chamber when the hanger is in a secure position with the locking arm locked and the door is removable from the cooking chamber when the hanger is in an attachable position with the locking arm unlocked.

The hanger may be a generally planar plate with opposed faces and opposed ends, and pivotally mounted to the door toward one end. At the other end, the hanger has an opening formed by a generally unshaped channel that engages the door with the cooking chamber. The channel opening is closed by the hanger channel and the arm channel when the locking arm is pivoted into the locked position and the channel opening is opened when the locking arm is pivoted into the unlocked position.

The locking arm on the hanger has opposed edges and opposed faces, with a detent on one face to provide friction between the locking arm and the hanger to help keep the locking arm in a locked or unlocked position.

Additionally, the locking arm has opposed ends, with one end mounted to the hanger for pivotal movement between a locked and unlocked position. Preferably, a handle extends from the other end of the locking arm to facilitate movement between the locked and unlocked positions of the locking arm.

The invention also provides for a blocking portion formed on one edge of the locking arm that keeps the hanger in the attachable position with the locking arm unlocked. An arm channel is located on the second edge and cooperates with the hanger to secure the door on the chamber.

The invention provides a member with opposed ends that is secured to the door toward one end and pivotally mounted to the hanger toward the second end. An ear extends outwardly from the second end of the member and engages a blocking portion on the locking arm when it is pivoted into the open position. This action holds the locking arm in the open position for easy removal of the door.

Further, this invention comprises a hinge assembly for an oven or range having a door and a cooking chamber. The hinge assembly has a hanger mounted to the door, at least one pin on the chamber, at least one channel on the hanger for receiving the pin, and a locking arm pivotally mounted to the hanger for movement between an unlocked position with the channel open for receiving the pin and a locked position with the channel and the locking arm enclosing the pin.

DESCRIPTION OF THE PREFERRED EMBODIMENT

The present invention may be used with an oven or range as disclosed in U.S. patent application Ser. No. 60/053,721 filed Jul. 25, 1997, the disclosure of which is hereby incorporated by reference.

Figure 1:
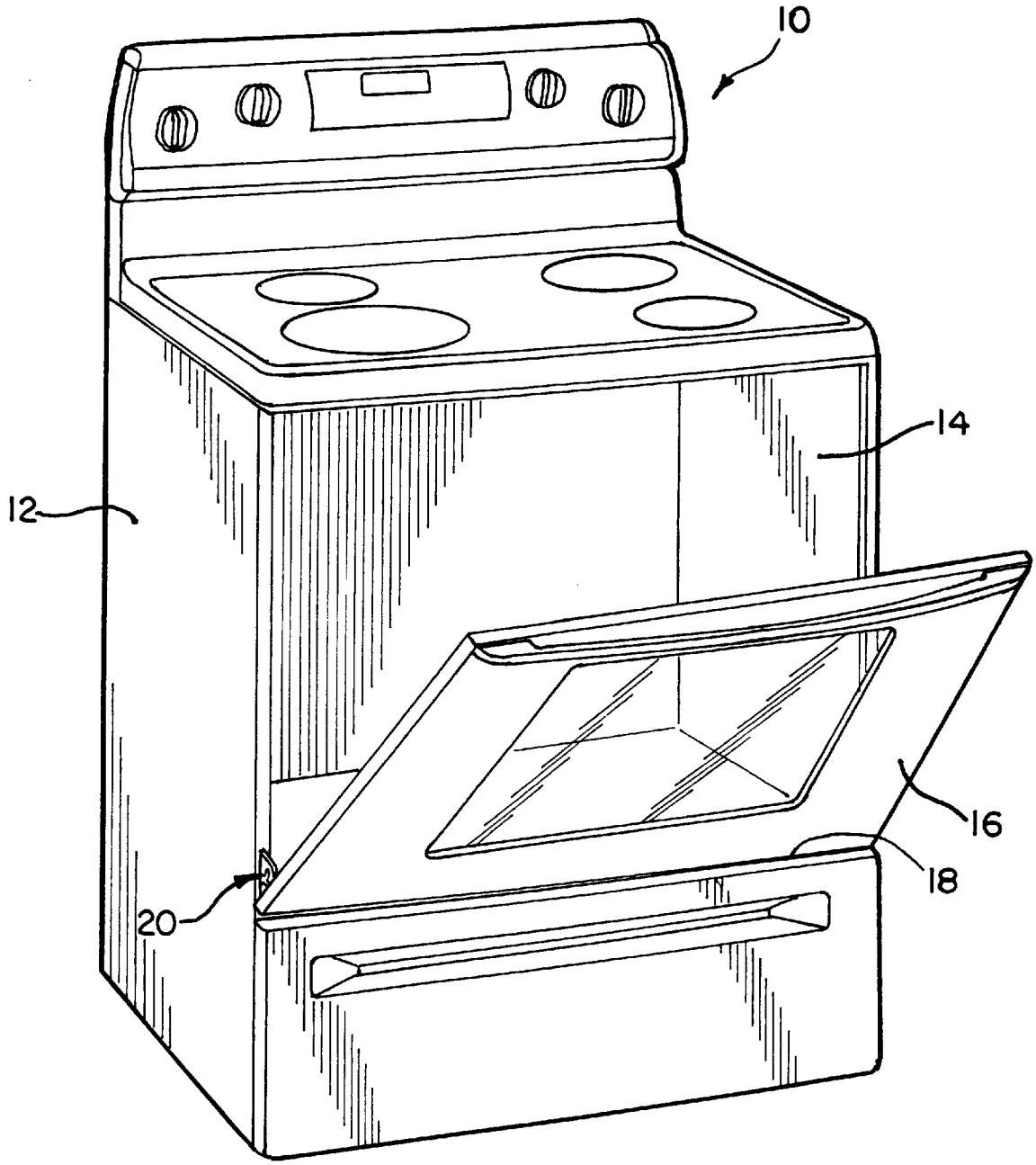
FIG. 1 is a perspective view of a stand-alone oven incorporating an oven door with a door lock assembly according to the present invention.

FIG. 1 illustrates an oven 10 providing the environment of the invention. The oven comprises a cabinet 12 housing a cooking chamber 14. A door 16 is attached to the cooking chamber 14 along an edge 18 for opening and closing the cooking chamber 14. The door 16 can be locked on or removed from the cooking chamber 14 using the present invention hinge assembly, generally designated as 20. The oven 10 may have two hinge assemblies as shown in FIG. 1, a right hinge assembly at the bottom right edge of the door and a left hinge assembly at the bottom left edge of the door. However, the following description is limited to the left-hand assembly, it being understood that the right-hand assembly would be reversely identical.

Figure 5:
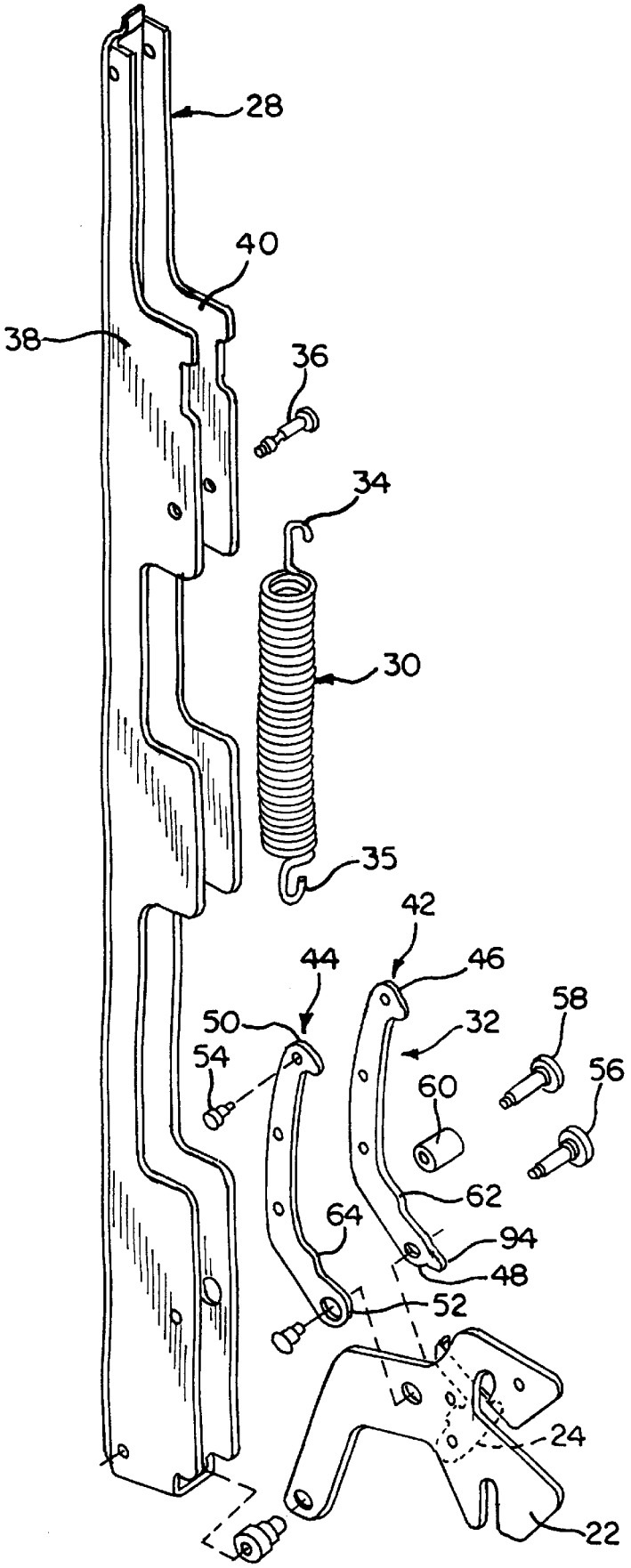
FIG. 5 is a perspective view of the door lock assembly attached to the pivot assembly.

The hinge assembly 20 includes a hanger 22 and a locking arm 24 that are mounted to a pivot assembly 26. The pivot assembly 26 is mounted in the door 16 to allow the cooking chamber 14 to be opened and closed by the door. As seen in FIG. 5, the pivot assembly 26 may be similar to that shown in U.S. patent application Ser. No. 60/053,721 with a u-shaped channel 28 housing a spring 30 and an arm member 32. The spring 30 may be connected to the channel 28 at one end and the arm member 32 at the other end.

As seen in FIG. 5, the spring 30 has a hook at each end 34, 35 that hooks a pin 36 extending between the two side walls 38, 40 of the channel at one end and hooks the arm member 32 at the other end. The spring 30 is stretched when the door 16 is opened and relaxed when the door is closed.

The arm member 32 consists of two substantially identical arms 42, 44 spaced apart in a substantially mirror image configuration. The arms 42, 44 are somewhat arcuate in shape, each arm 42, 44 having an interior edge 62, 64. Each arm 42, 44 has opposed ends 46, 48 and 50, 52 with first ends 46, 50 being spaced apart by a pin 54 extending therebetween. The spring 30 is hooked to the pin 54 by its hook 35. The two arms 42, 44 sandwich the hanger 22 between their respective second ends 48, 52, with a pin 56 extending therethrough for pivoting action of the hanger 22 and the arm member 32.

As seen in FIG. 5, there is a pin 58 extending between the two side walls 38, 40 of the channel substantially encased by a sleeve 60 that rotates around the pin 58. The interior edges 62, 64 of the arms 42, 44 abut the sleeve 60 and slide along the sleeve as the spring 30 is stretched with the opening of the door 16.

Figure 2:
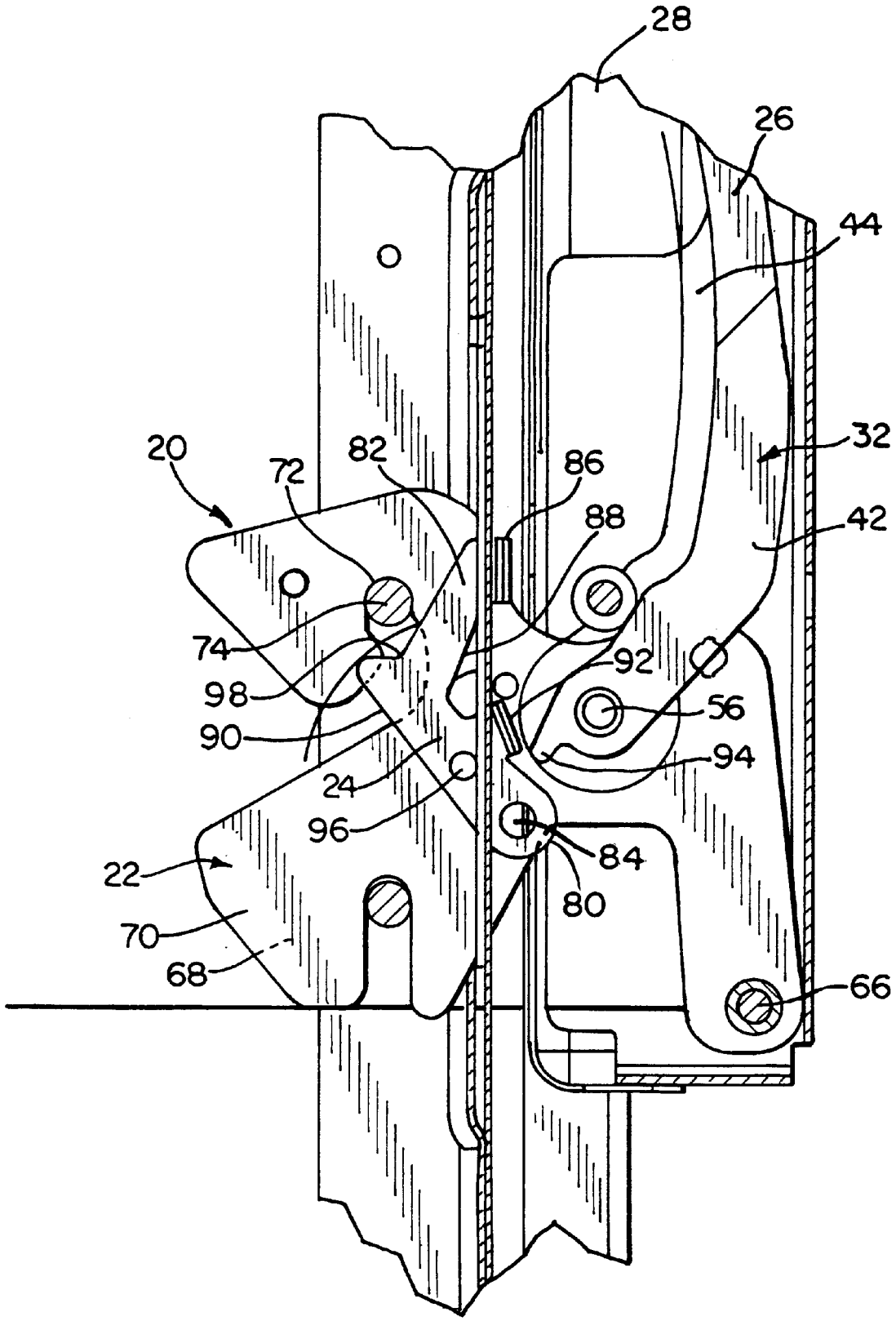
FIG. 2 is a left side sectional view of the left door lock assembly in the locked position.
Figure 4:
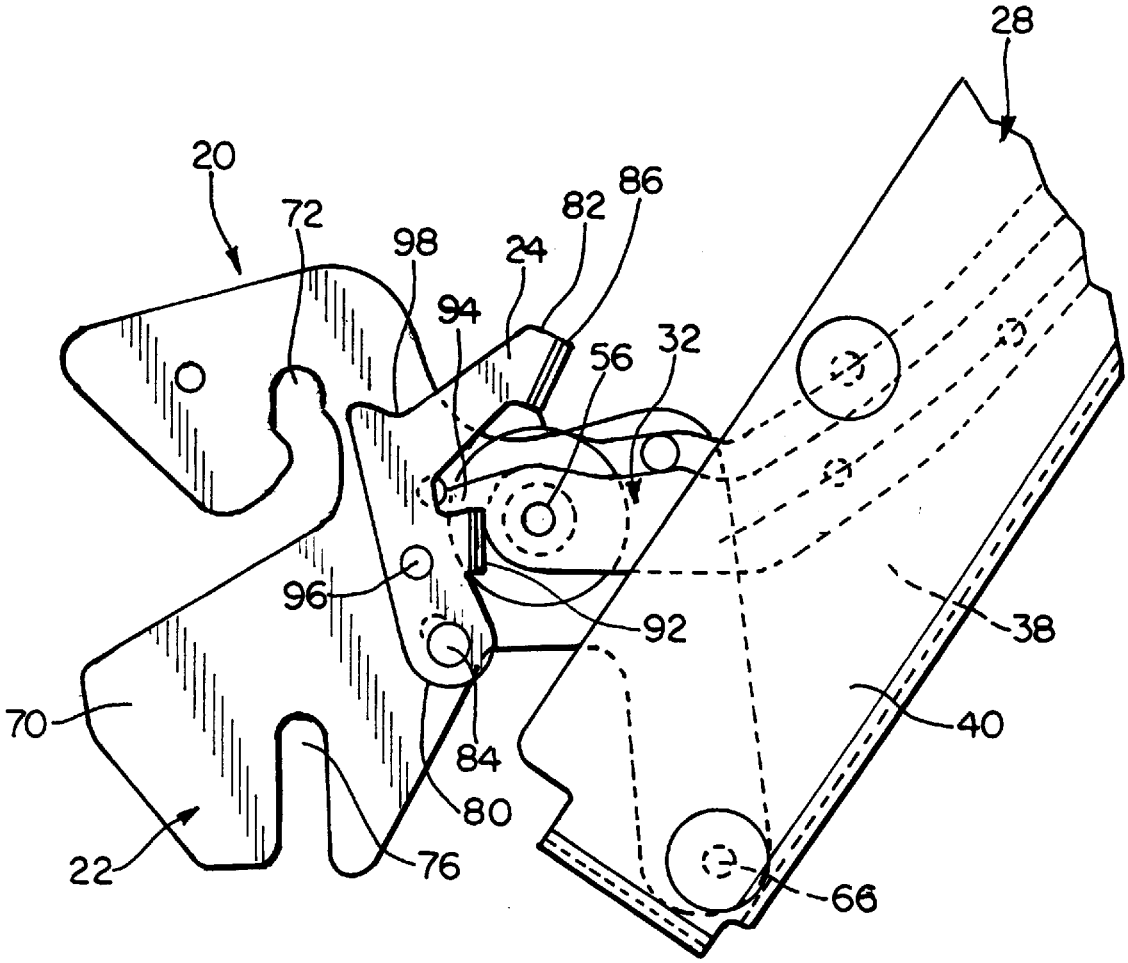
FIG. 4 is a left side sectional view of the left door lock assembly of FIG. 2 in the unlocked position.

As illustrated in FIGS. 2 and 4, the door 16 pivots about a horizontal axis with the hanger 22 remaining in a substantially fixed position when the door is opened and closed. The hanger is pivotally mounted to the channel 28 by a pin 66 that extends between the side walls 38, 40 and through the hanger 22 toward its bottom end. Since the hanger is pivotally mounted to the arm member 32 toward its top end at pin 56 and the hanger is pivotally mounted to the channel 28 toward its bottom end at pin 66, the hanger remains substantially stationary as the spring 30 is stretched and relaxed with the opening and closing action of the door 16.

Figure 3:
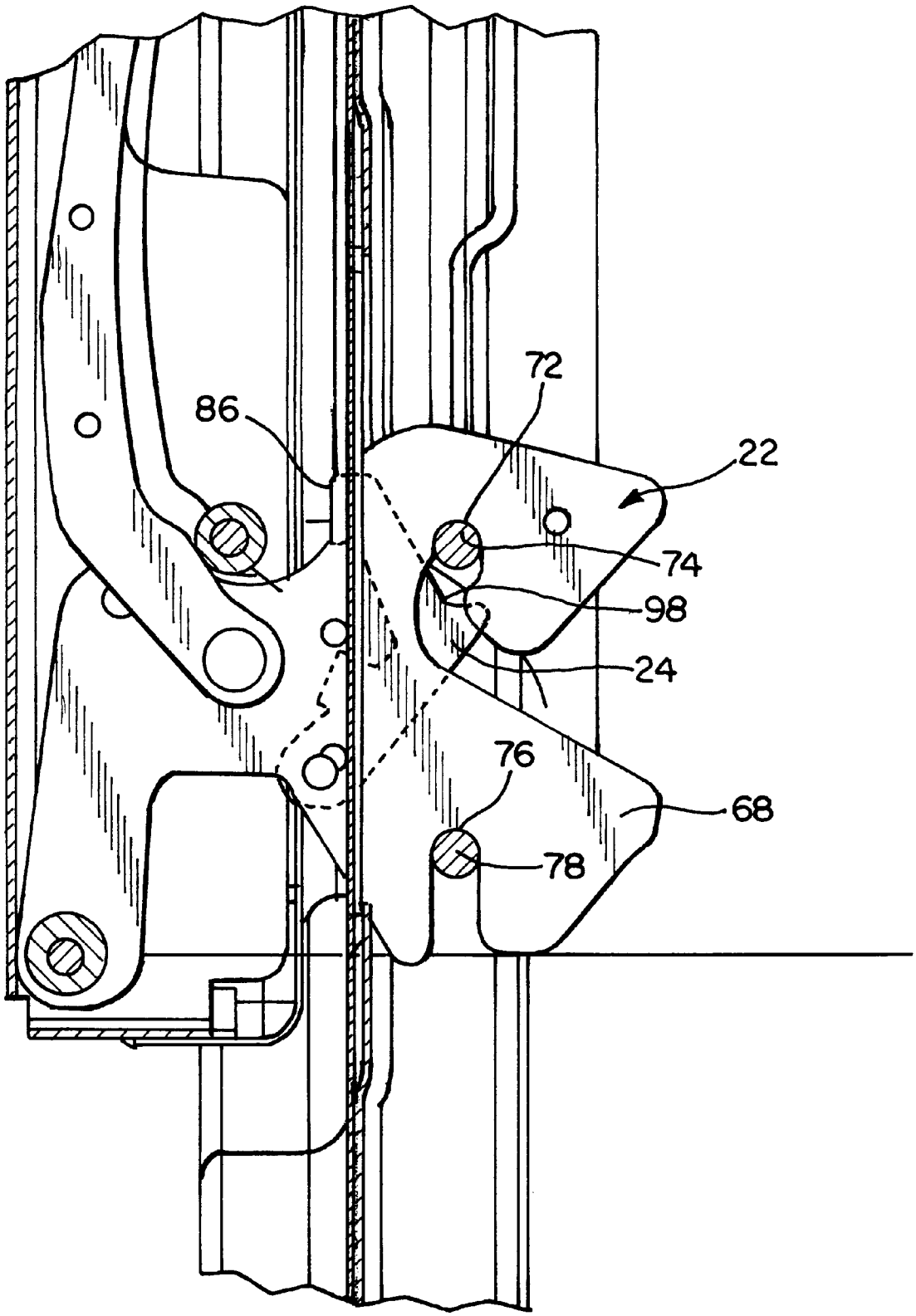
FIG. 3 is a right side sectional view of the left door lock assembly in the locked position.

The hanger has opposed faces, a right face 68 directed toward the door 16 and a left face 70 directed away from the door, with the locking arm 24 mounted on the left face. The hanger has at least one channel 72 for receiving a pin 74 located on the cooking chamber 14. As shown in FIG. 3, two channels 72, 76 may be provided in somewhat stacked relation on the hanger for receiving two oven pins 74, 78. The channels 72, 76 have somewhat of an upside down U configuration for engagement of the pins 74, 78 in a downward motion.

The locking arm has two ends 80, 82 and pivots about a pin or rivet 84 at the first end 80 in a swinging motion that is substantially planar to the face of the hanger 22. The locking arm 24 has a handle 86 extending from the second end 82 to facilitate the swinging motion of the locking arm.

As seen in FIGS. 2 and 4, the locking arm has opposed edges 88, 90 with a blocking portion 92 formed on the first edge 88 to keep the hanger 22 in the unlocked position. The blocking portion 92 may be a flange formed substantially perpendicular to the locking arm 24. The blocking portion 92 cooperates with an ear 94 extending from the second end 48 of the arm 42 that is located on the outside of the left hanger face 70. The ear 94 is a protruding member that keeps the spring 30 extended and the arm 42 in a fixed position when the blocking portion 92 is rotated to engage the ear 94, as seen in FIG. 4. The ear and blocking portion are disengaged by extending the spring 30 further, thus rotating the ear 94 out of engagement with the blocking portion 92, and swinging the locking arm 24 so the blocking portion is away from the ear, as shown in FIG. 2.

In FIGS. 2 and 4, a detent 96 is shown on the locking arm 24 toward the first end 80. The detent 96 slides along the face 70 of the hanger 22 when the locking arm 24 is swung from an open position to a closed position and friction keeps the locking arm in the position selected by the user.

A channel 98 is formed on the second edge 90 of the locking arm 24 for closing the hanger channel 72 opening. The hanger 22 is locked on the cooking chamber 14 by sliding the hanger channel 72 on to the oven pin 74 then swinging the locking arm 24 so that the channel 98 closes the hanger channel 72 opening, as illustrated in FIG. 2.

To attach the door 16 to the chamber 14, the door is pivoted horizontally along edge 18 about pin 66, then the locking arm 24 is pivoted to an open position using the handle 86. The locking arm 24 is kept in the open position by engaging the blocking portion 92 and the ear 94, as shown in FIG. 4. The hanger 22 is then attached to the cooking chamber 14 by sliding the hanger channel 72 on oven pin 74. The hanger 22 is then locked on the chamber 14 by pivoting the door 16 further and swinging the blocking portion 92 out of engagement with the ear 94 and toward the pin 74. The pin 74 is then trapped between the hanger channel 72 and the locking arm channel 98 resulting in the door 16 being locked to the chamber 14, as shown in FIGS. 2 and 3.

To remove the door 16 from the cooking chamber 14, the door is pivoted open far enough to swing the blocking portion 92 of the locking arm 24 into engagement with the ear 94. Then, with the hanger channel 72 now open, the hanger 22 can be lifted off of the oven pin 74, thus removing the door 16.

By again pivoting the door 16 far enough to engage the blocking portion 92 with the ear 94 to hold the hanger 22 in the unlocked position, the door can be reattached.

While the present invention has been described with reference to the above described embodiment, those of skill in the art will recognize that changes may be made thereto without departing from the scope of the invention as set forth in the appended claims.

We claim:

1. An oven having a door, cooking chamber, and a hinge assembly, the hinge assembly comprising:

a hanger mounted to the door;

at least one pin on the oven chamber;

at least one channel on the hanger for receiving the pin;

a locking arm pivotally mounted to the hanger for movement between an unlocked position with the channel open for receiving the pin and a locked position with the channel and the locking arm enclosing the pin.

2. An oven having a door, cooking chamber, and a hinge assembly, the door pivoting about a horizontal axis to open and close the cooking chamber, the hinge assembly comprising:

a hanger pivotally mounted to the door for attaching the door to a pin located on the cooking chamber; the door being securely attached to the cooking chamber when the hanger is in a locked position and the door being removable from the cooking chamber when the hanger is in an unlocked position; and a locking arm mounted to the hanger for locking the hanger and the door on the cooking chamber; the locking arm comprises opposing first and second edges and opposing first and second faces, the first face having a detent for providing friction between the locking arm and the hanger to facilitate keeping the locking arm in the locked and unlocked positions.

3. A hinge assembly as defined in claim 2, wherein;

the locking arm has opposing first and second ends, the first end being pivotally mounted to the hanger for movement of the locking arm between the locked position with the door securely attached to the cooking chamber and the unlocked position with the door capable of being removed from and attached to the cooking chamber.

4. A hinge assembly as defined in claim 3, further comprising:

a handle extending from the second end of the locking arm to facilitate movement between the locked and unlocked positions of the locking arm.

5. An oven having a door, cooking chamber, and a hinge assembly, the door pivoting about a horizontal axis to open and close the cooking chamber, the hinge assembly comprising:

a hanger pivotally mounted to the door for attaching the door to the cooking chamber;

a locking arm mounted to the hanger for locking the hanger and the door on the cooking chamber;

said locking arm comprises opposing first and second edges and opposing first and second faces, the first face having a detent for providing friction between the locking arm and the hanger to facilitate keeping the locking arm in a locked and an unlocked position;

said locking arm having opposing first and second ends, the first end being pivotally mounted to the hanger for movement of the locking arm between the locked position with the door securely attached to the cooking chamber and the unlocked position with the door capable of being removed from and attached to the cooking chamber; and a blocking portion formed on the first edge of the locking arm for keeping the hanger in the unlocked position.

6. A hinge assembly as defined in claim 5, further comprising:

a member having first and second ends, the member being secured to the door toward the first end and pivotally mounted to the hanger toward the second end; and an ear extending outwardly from the second end of the member, the ear engaging a blocking portion when the locking arm is pivoted into the open position, holding the locking arm in the open position for easy removal of the door.

7. An oven having a door, cooking chamber, and a hinge assembly, the door pivoting about a horizontal axis to open and close the cooking chamber, the hinge assembly comprising:

a hanger pivotally mounted to the door for attaching the door to the cooking chamber;

a locking arm mounted to the hanger for locking the hanger and the door on the cooking chamber;

said locking arm comprises opposing first and second edges and opposing first and second faces, the first face having a detent for providing friction between the locking arm and the hanger to facilitate keeping the locking arm in a locked and an unlocked position;

said locking arm having opposing first and second ends, the first end being pivotally mounted to the hanger for movement of the locking arm between the locked position with the door securely attached to the cooking chamber and the unlocked position with the door capable of being removed from and attached to the cooking chamber; and an arm channel provided on the second edge of the locking arm and cooperating with the hanger to secure the door on the oven chamber when the hanger is in the locked position.

8. A hinge assembly as defined in claim 7, wherein;

the hanger comprises a generally planar plate having opposing first and second faces and opposing first and second ends, the first end being pivotally mounted to the door.

9. A hinge assembly as defined in claim 8, wherein;

the hanger has an opening formed by a generally unshaped hanger channel at the second end for engagement of the door with the cooking chamber.

10. A hinge assembly as defined in claim 9, wherein:

the channel opening is closed by the hanger channel and the arm channel when the locking arm is pivoted about the first end into the locked position and the channel opening is opened when the locking arm is pivoted about the first end into the unlocked position.

* * * * *